US005523674A

United States Patent [19]

Dohnal et al.

[11] Patent Number: 5,523,674

[45] Date of Patent: Jun. 4, 1996

[54] STEP SWITCH

[75] Inventors: Dieter Dohnal, Lappersdorf; Josef Neumeyer, Waldetzenberg; Wolfgang Albrecht, Wenzenbach; Günter Kloth, Saal; Rolf Lauterwald, Pettendorf; Hans-Henning Lessmann-Mieske, Neutraubling, all of Germany

[73] Assignee: Maschinenfabrik Reinhausen GmbH, Regensburg, Germany

[21] Appl. No.: 313,205

[22] PCT Filed: May 6, 1993

[86] PCT No.: PCT/EP93/01112

§ 371 Date: Sep. 27, 1994

§ 102(e) Date: Sep. 27, 1994

[87] PCT Pub. No.: WO94/02955

PCT Pub. Date: Feb. 3, 1994

[30] Foreign Application Priority Data

| | | | |
|---|---|---|---|
| Jul. 16, 1992 | [DE] | Germany | 42 23 439.5 |
| Nov. 4, 1992 | [DE] | Germany | 42 37 231.3 |
| Nov. 4, 1992 | [DE] | Germany | 42 37 165.1 |

[51] Int. Cl.[6] ..... H01F 29/04

[52] U.S. Cl. ..... 323/340; 200/11 TC; 336/150; 323/341

[58] Field of Search ..... 218/10, 140, 153, 218/154, 119, 143, 2, 4, 5, 7; 200/11 TC, 16 F, 11 B, 15, 18; 323/255, 340, 341, 343

[56] References Cited

U.S. PATENT DOCUMENTS

| | | | |
|---|---|---|---|
| 3,571,543 | 3/1971 | Perkins et al. | 218/10 |
| 3,579,092 | 5/1971 | Matzl | 323/343 |
| 3,590,175 | 6/1971 | Bleibtreu et al. | 200/11 TC |
| 3,614,597 | 10/1971 | Van Riemsdijk | 323/340 |
| 3,628,128 | 12/1971 | Buhler | 323/340 |
| 3,643,154 | 2/1972 | Van Riemsdijk | 323/340 |
| 3,935,407 | 1/1976 | Bleibtreu et al. | 218/2 |
| 4,081,741 | 3/1978 | Palmer | 323/340 |
| 4,931,599 | 6/1990 | Bleibtreu | 200/11 B |
| 4,978,815 | 12/1990 | Berger et al. | 200/11 TC |
| 5,107,200 | 4/1992 | Dohnal et al. | 323/340 |

FOREIGN PATENT DOCUMENTS

| | | | |
|---|---|---|---|
| 113953 | 7/1984 | European Pat. Off. | H01H 9/00 |
| 2135367 | 12/1972 | France | H01H 15/00 |
| 756435 | 10/1952 | Germany . | |
| 1638931 | 6/1971 | Germany | H01H 9/00 |
| 2321369 | 11/1974 | Germany | H01F 29/04 |
| 3719680 | 2/1988 | Germany | H01F 29/04 |
| 3943514 | 12/1989 | Germany | H01F 29/04 |
| 2000911 | 1/1979 | United Kingdom | H01H 1/56 |

*Primary Examiner*—J. R. Scott
*Attorney, Agent, or Firm*—Herbert Dubno

[57] ABSTRACT

The invention relates to a load selector for step switches in step transformers with two movable selector contacts. A suitable vacuum switch is located downstream of the first movable selector contact to switch the load current and a suitable switch for switching the compensation current is located downstream of the second movable selector contact. Both of the selector contacts are independently movable in such a way that one of the selector contacts moves slowly and the other selector contact rapidly moves or jumps between positions. The sequence of operation of the selector contacts is independent of the switching direction.

13 Claims, 8 Drawing Sheets

STEP SWITCH

CROSS-REFERENCE TO RELATED APPLICATIONS

This application is the U.S. national phase of PCT application PCT/EP93/01112 filed 6 May 1993 with a claim to the priority of German patent applications P 42 23 439.5 filed 16 Jul. 1992, P 42 37 231.3 filed 4 Nov. 1992, and P 42 32 165 also filed 4 Nov. 1992 (and all now issued as German patents).

FIELD OF THE INVENTION

The invention relates to a step switch for step transformers with two movable selector contacts.

BACKGROUND OF THE INVENTION

In such a known step switch as described in German patent document 2,321,369 there are two selector arms each carrying a respective selector contact, the first of the movable selector contacts being connected to a vacuum switch intended for continuous-current transmission and interruption and the second of the movable selector contacts being connected to a vacuum switch and series-connected shunt resistor intended only for conducting and interrupting the compensating current. The two movable selector contacts are connected to each other and to the vacuum switch so that when the switching direction changes the rotation direction of the drive also changes and during each indexing of the second selector contact the vacuum switch that is intended only to conduct and interrupt the compensating current in series with the shunt resistor is left connected momentarily all alone to the tap at high voltage. With this known step switch according to the switching direction the resistance contact either leads or trails; the switching procedure is different depending on switching direction.

As a result both of the arms carrying the respective selector contacts must be jointly actuated by the energy-storage unit; this is particularly disadvantage due to the complex kinematics as well as the mechanically costly energy-storage unit which is required in particular by the different switching steps depending on switching direction.

OBJECT OF THE INVENTION

It is therefore an object of the invention to provide a step switch whose kinematics are very simple and which requires for actuating the switching means an energy-storage unit that is uncomplicated and that works the same in both directions with the same switching steps.

SUMMARY OF THE INVENTION

A step switch is used with a step transformer having a row of contacts including at least a first contact and an adjacent second contact. The step switch has a threaded drive shaft extending along the row of transformer contacts, a support movable relative to the drive shaft along the row of transformer contacts and threaded on the drive shaft, and a fixed contact fixed on the support and movable therewith along the row of transformer contacts to successively engage same. A buss conductor extending longitudinally along the row of transformer contacts is connected via a vacuum switch to the fixed contact. The shaft is rotated in one sense to slowly displace the support in one direction along the row for displacement of the fixed contact from the first contact to the second contact and in the opposite direction along the row for displacement of the fixed contact slowly in the opposite direction from the second contact to the first contact. A slide movable relative to the drive shaft and to the support carries a movable contact and a switch and a resistor are connected between the movable contact and the buss conductor. A spring-loaded force-storage unit is braced between the slide and the support for, on movement of the fixed contact from the first contact to the second contact, rapidly displacing the movable contact from the first contact to the second contact once the fixed contact is moved fully to the second contact and on opposite movement of the support by the shaft for, on movement of the fixed contact from the second contact to the first contact, rapidly displacing the movable contact from the second contact to the first contact once the fixed contact is moved to the first contact.

It is a particular advantage of the step switch according to the invention that—independent of the switching direction and therefore of the rotation direction of the drive—the auxiliary contact always leads and thus must only be actuated slowly, the particular advantage being that the step switch is directly actuated by the drive shaft. The energy storage unit therefore only actuates the always trailing main contact so that a particularly simple energy-storage unit results.

With the step switch according to the invention the main and auxiliary contacts are completely independently movable: The auxiliary contact is continuously moved by the slowly rotating drive shaft and in effect selects the new to be switched transformer tap while the main contact is made to follow with a jump by the energy-storage unit.

In a further advantageous embodiment of the invention the main and auxiliary contacts are vertically separate from each other and pivotal about a common axis independently of each other and the fixed contacts, which are concentric to this axis, which are each connected with a tap of the step winding, extend vertically so far that the main and also the auxiliary contacts can slide over them.

While it is known from German published application 2,219,220 to provide fixed contacts that contact rollers can slide over in several vertical planes this known arrangement serves mainly to improve the spatial relationships as several coupled-together rollers roll over them.

According to a further advantageous embodiment of the invention it is also possible to arrange the fixed contacts in a straight row as in slide switches and to form the movable contacts so that even in this case they can slide unhindered over them. This can be done by making the fixed contact U-shaped so that the adjacent contact rollers or blades or the like that are next to each other can slide over them.

It is particularly advantageous, in order to increase resistance to failure, to connect in series with the vacuum switch which continuously passes the voltage of the first movable selector contact a similar vacuum switch and to actuate these two vacuum switches generally at the same time.

It is also possible to mount all the switching elements on one of the movable contacts and to provide only an electrical connection to the other movable switching contact.

BRIEF DESCRIPTION OF THE DRAWING

The invention is more closely described by way of example below with reference to drawings.

SPECIFIC DESCRIPTION

Figure 1:
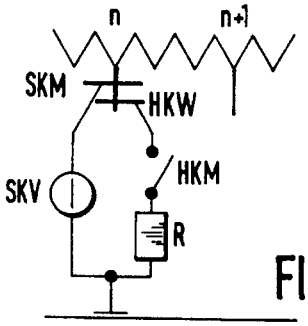
FIG. 1 is a first step switch according to the invention in a schematic view.

In the schematic diagram of FIG. 1 taps of the step winding of a step transformer are connected with fixed contacts n, (n+1), . . . , (n+m) which can be arranged in a circle or straight line. The step switch also has a switching contact SKM which is connected via a vacuum switch SKV with the common conductor and an auxiliary contact HKW that is independent therefrom and movable without a mechanical connection and which is connected in series through an auxiliary switch HKM and a shunt resistor R to the same conductor.

Figure 2:
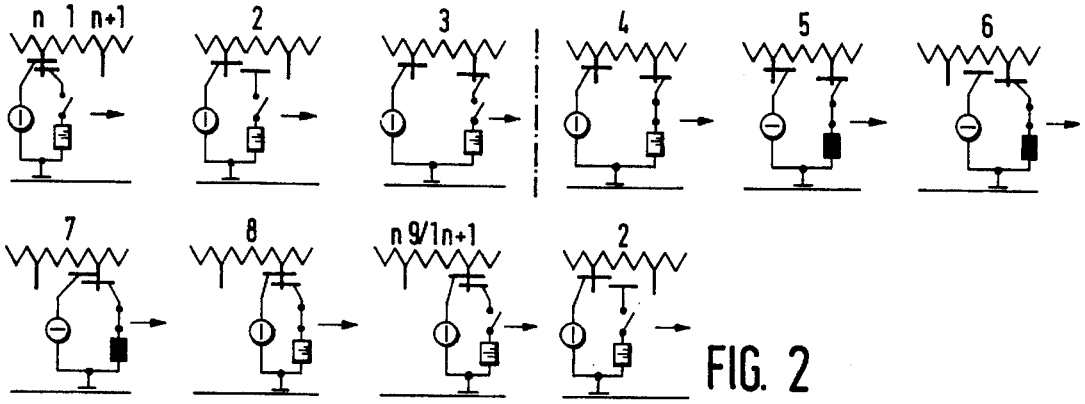
FIG. 2 shows the necessary switching steps of this first step switch on switching from one transformer tap to another.

FIG. 2 shows the necessary switching steps. These switching steps are the same if the switching is going from a lower to a higher voltage level or oppositely. The individual switching steps are shown at 1 through 9.

Figure 3:
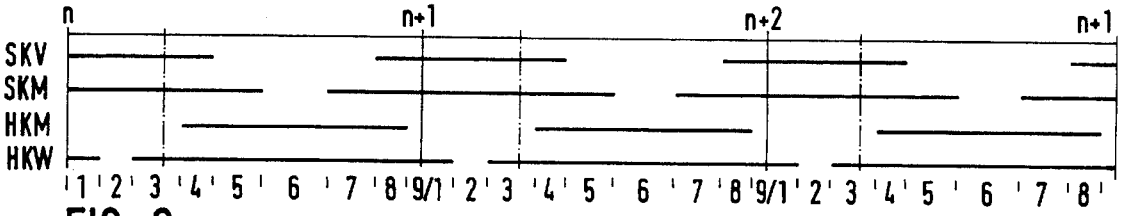
FIG. 3 is the corresponding switching diagram of this first step switch when switching from n to (n+1), then to (n+2), and finally then back to (n+1)

FIG. 3 shows the switching diagram for a multiple step switching from n to (n+1), then to (n+2) and then back to (n+1).

It is clear that regardless if one is switching to a higher or lower voltage level the auxiliary contact HKW always leads and carries out a preselection. Meanwhile the fixed contacts n, (n+1), (n+2), are so constructed that they can be switched independently from each other and from the auxiliary contact HKW.

Figure 4:
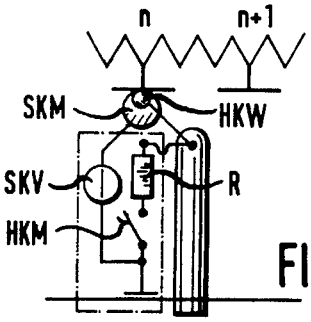
FIG. 4 shows a different form of this step switch with all elements mounted on a movable arm which here carries the main contact SKM.

FIG. 4 schematically illustrates a variation on such a step switch where all the elements are mounted on a movable arm AR which here carries the main contact SKM and this arm AR, which is shown in dot-dash lines, is connected with the conductor. The auxiliary contact HKW which is once again independently movable is insulated and is electrically connected with the arm AR carrying the main contact SKM.

Figure 5:
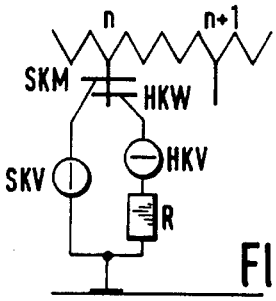
FIG. 5 is a second embodiment of a step switch according to the invention in a schematic representation.

FIG. 5 shows another embodiment wherein the mechanical auxiliary switch HKM is replaced by another vacuum switch HKV.

Figure 6:
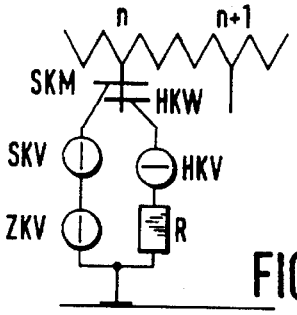
FIG. 6 is shows a third embodiment of a step switch according to the invention in a schematic representation.

FIG. 6 shows a further embodiment of a step switch where the movable switch contact SKM is connected in series through two vacuum switches SKV and ZKV to the conductor. Such an arrangement provides much greater security with respect to failure of a vacuum switch in the load line.

FIG. 7 again shows the corresponding switching diagram with a switching from n to (n+1), then to (n+2), and then back again to (n+1).

Figure 8:
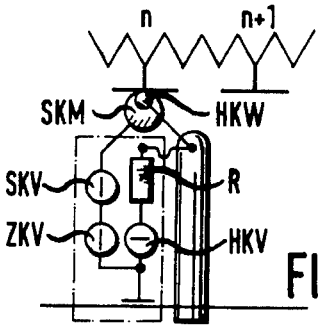
FIG. 8 again shows a different form of this third step switch where all elements are again mounted on a movable arm which here carries the main contact SKM.

FIG. 8 shows a step switch according to FIG. 6 in a variant with all the switch elements mounted on a movable arm AR which here carries the main contact SKM. The auxiliary contact HKW that is movable independently thereof is again insulatedly mounted and connected electrically with the arm AR carrying the main contact SKM.

Figure 9:
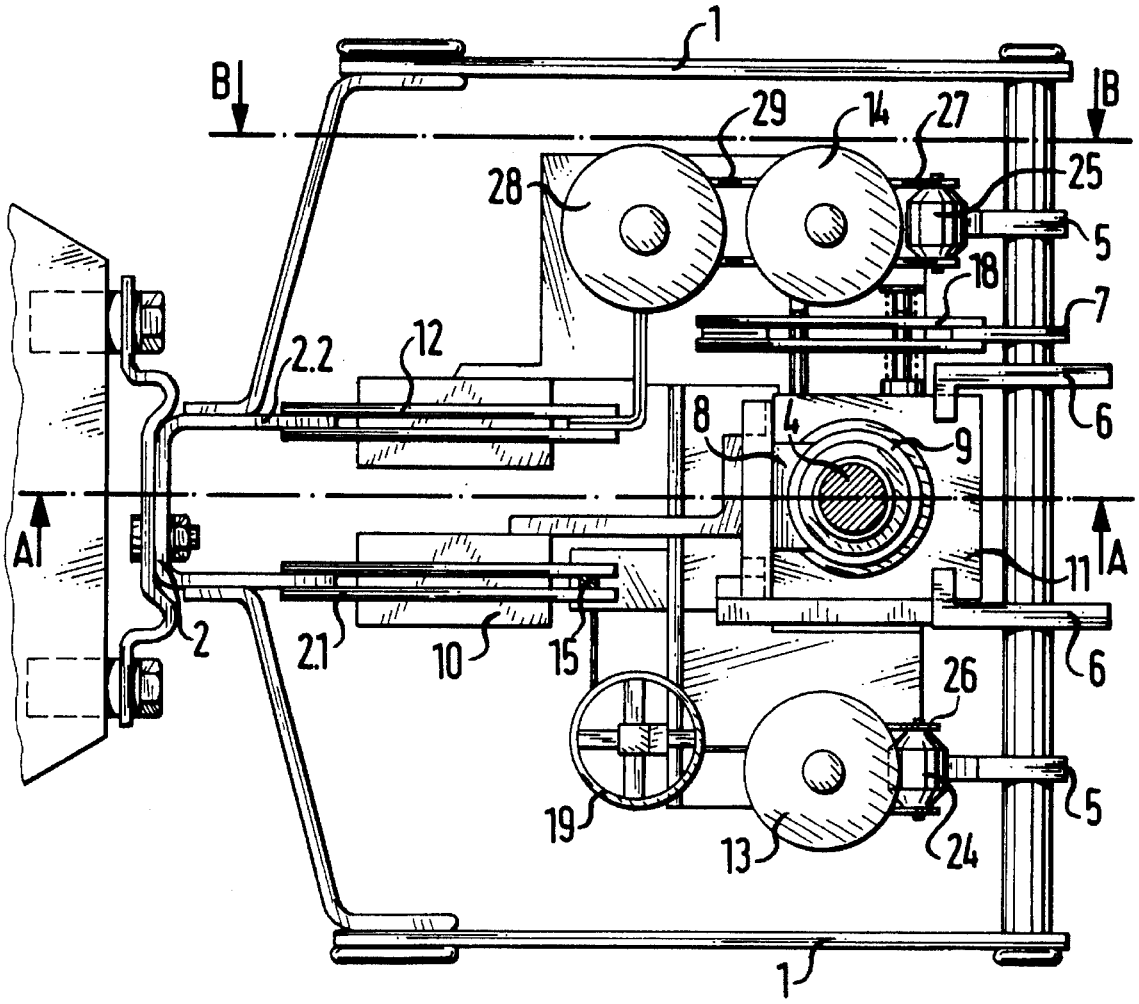
FIG. 9 shows in top view the construction of a step switch schematically shown in FIG. 8.
Figure 10:
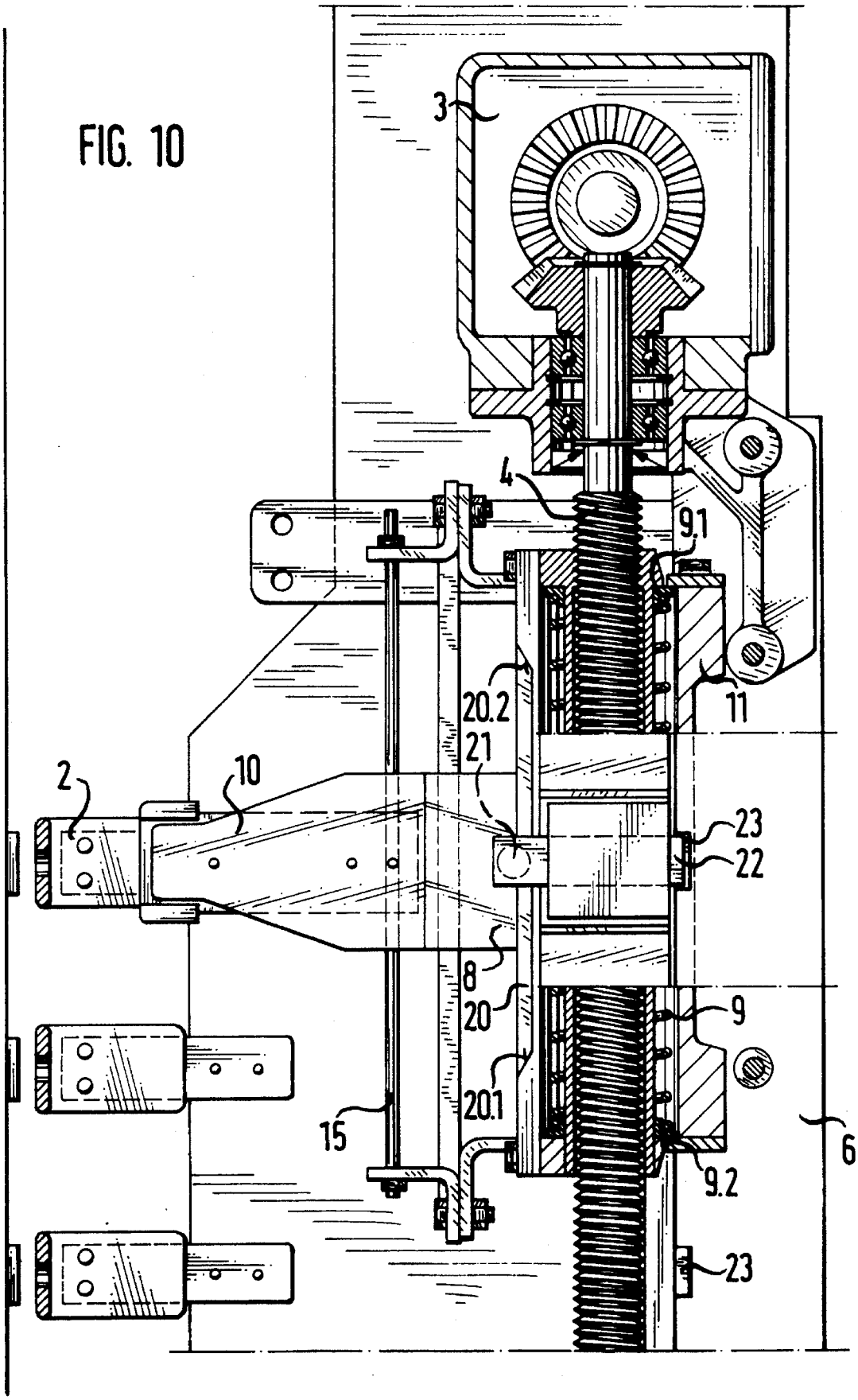
FIG. 10 also shows this step switch in a side view in plane X—X of FIG. 9.
Figure 11:
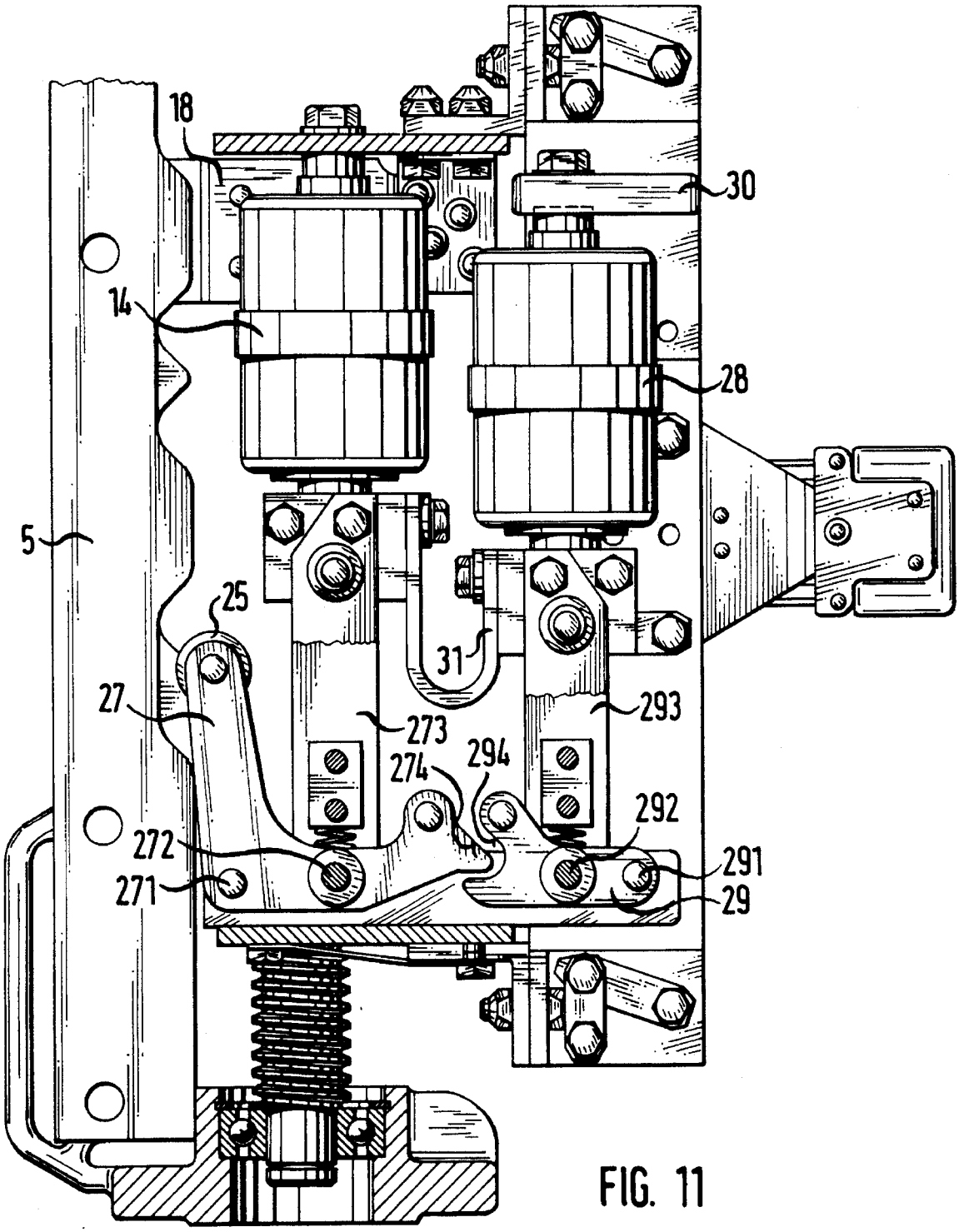
FIG. 11 is the same step switch in a side view in plane X1—X1 of FIG. 9.
Figure 12:
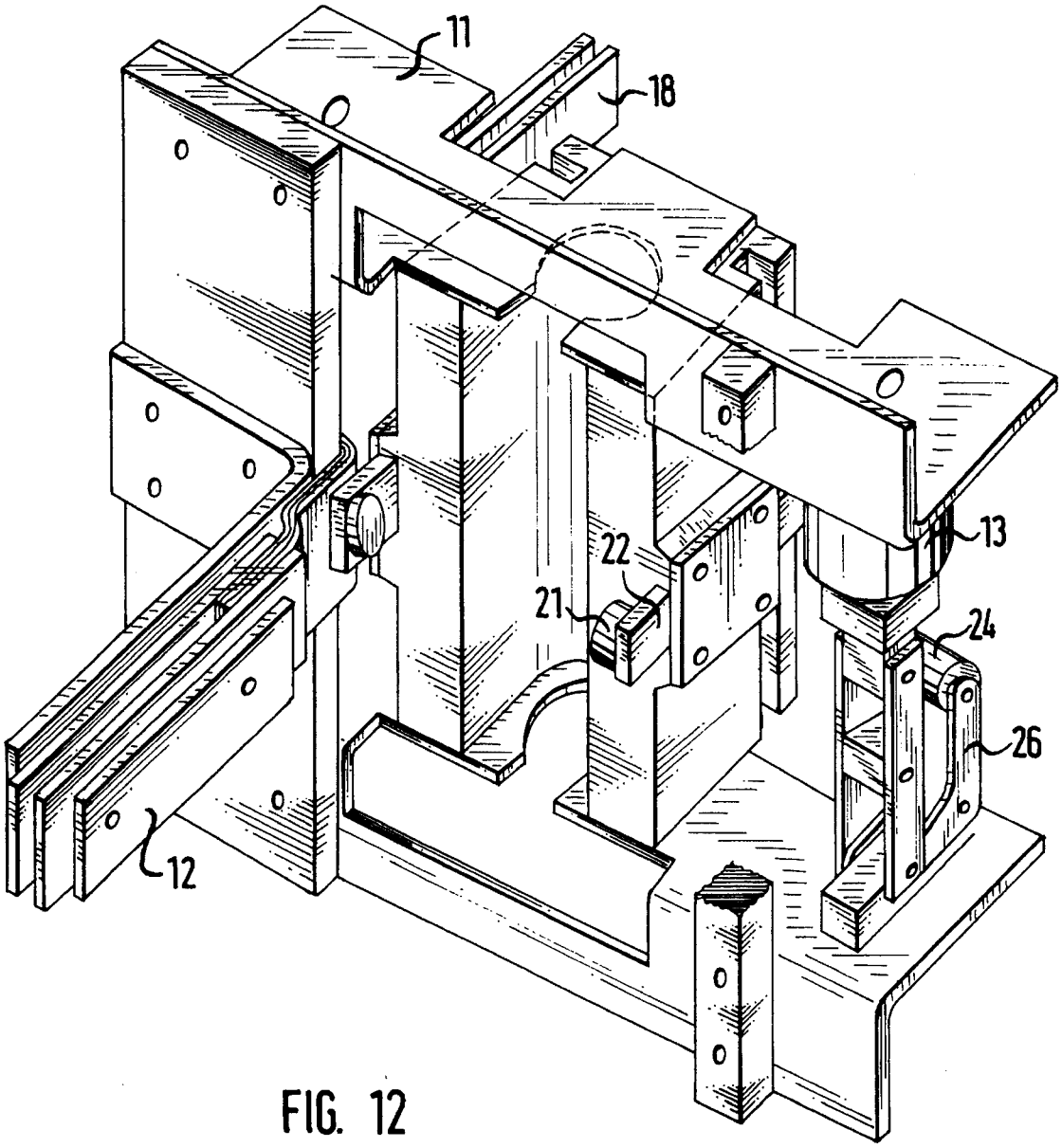
FIG. 12 is an individual driven part in a partly perspective representation.

FIG. 9 shows the construction of a step switch according to FIG. 8 from above, FIG. 10 shows this same step switch from the side in the plane A—A, and FIG. 11 in the plane B—B.

The step switch comprises a housing 1 on whose end wall are vertically arranged the step contacts 2 which each are formed of two contact parts 2.1 and 2.2 which extend parallel to each other into the interior of the step switch. A threaded spindle 4 of a drive 3 projects downward into the housing 1. The side of the housing 1 opposite the fixed step contacts 2 carries two cam rails 5, two guide rails 6, and a conductor rail 7 whose functions are described more closely below. The step switch further has a spring-type energy-storage unit which is formed of a tubular slide 8 which is surrounded by a compression spring 9 which in its turn surrounds the threaded spindle 4 that drives it. The slide 8 supports on insulation a preselecting auxiliary contact 10 which passes over or engages a contact part 2.1 of the selected fixed contact 2 and is fixed to a vertically extending release cam 20. The spring-type energy-storage unit further is comprised of a generally U-shaped driven part 11. Integrally fixed on the driven part 11 to follow the snap-action movement of same when released are a switching contact 12 which switches respective further contact parts of each fixed step contact 2, three vacuum switches 13, 14, and 28, a conductive contact bar 15, further rollers 24 and 25, as well as two-armed levers 26, 27, and 29 for actuating the vacuum switches 13, 14, and 28, as well as a contact blade 18 that is in contact with the conductor bar 7, and finally at least one shunt resistor 19.

For switching the threaded spindle 4 rotates and moves the surrounding tubular slide 8 continuously upward or downward, depending on rotation direction. This compresses the spring 9 which is braced against an upper abutment 9.1 or a lower abutment 9.2; the spring-energy unit is loaded.

During this movement of the slide 8 relative to the still stationary driven part 11 a roller 21 of a release slide bolt 22 of the driven part 11 rides along the also vertically moving cam 20 which has ramps 20.1 and 20.2.

Simultaneously the preselecting auxiliary contact 10 fixed via insulation on the slide 8 moves; it leaves the original fixed step contact 2 and reaches the next fixed contact positioned above or below. With its other end the preselecting auxiliary contact 10 rides on the contact rail 15 which is connected at least over a shunt resistor 19 with the vacuum cell 13. Subsequently the roller 21 comes to the respective ramp 20.1 or 20.2; the release lever 22 is shifted horizontally out of the stop 23 in the guide rail 6 and the entire driven part 11 jumps after the slide 8. At the same time the guide rail 6 assumes the function of mechanical vertical guiding.

The switching contact 12 now also leaves the previous fixed contact 2 and gets to a contact part of the new step contact whose other contact part is already engaged by the auxiliary contact 10. The auxiliary contact 10 is connected via the contact rail 15 through the series circuit of at least one shunt resistor 19 and the vacuum-tube switch 13 with the load conductor. The switch contact 12 itself is connected in series through the second vacuum-tube switch 14 and the third vacuum-tube switch 23 and with the contact blade 18 fixed thereto to the conductor 7 and thus also to the load.

Figure 7:
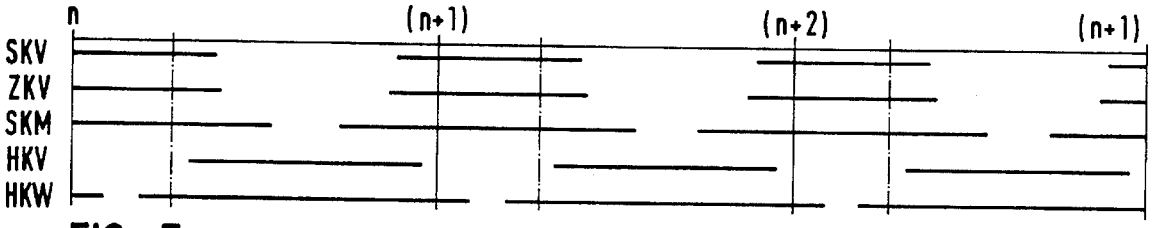
FIG. 7 shows the switching diagram of the third step switch again for a switching from n to (n+1), then to (n+2), and finally back to (n+1)

The two-arm lever 27 has a roller 25 which rides on the cam rail 5 and is deflected by its edge; the two-arm lever 27 is thus pivoted about its axis 271 and thereby actuates through the connection 272 the actuation lever 273 of the second vacuum switch 14. Simultaneously the actuation edge 274 engages against a corresponding actuation edge 294 of the second two-arm lever 29 which is thus also pivoted about its axis 291 and actuates via the connection 292 the further actuation lever 293 of the third vacuum switch 28. As a result of the space between the surfaces 274 and 294 of the levers 27 and 29 the actuation of the second vacuum switch takes place shortly before the actuation of the third vacuum switch 28 as shown in FIG. 7.

Figure 13:
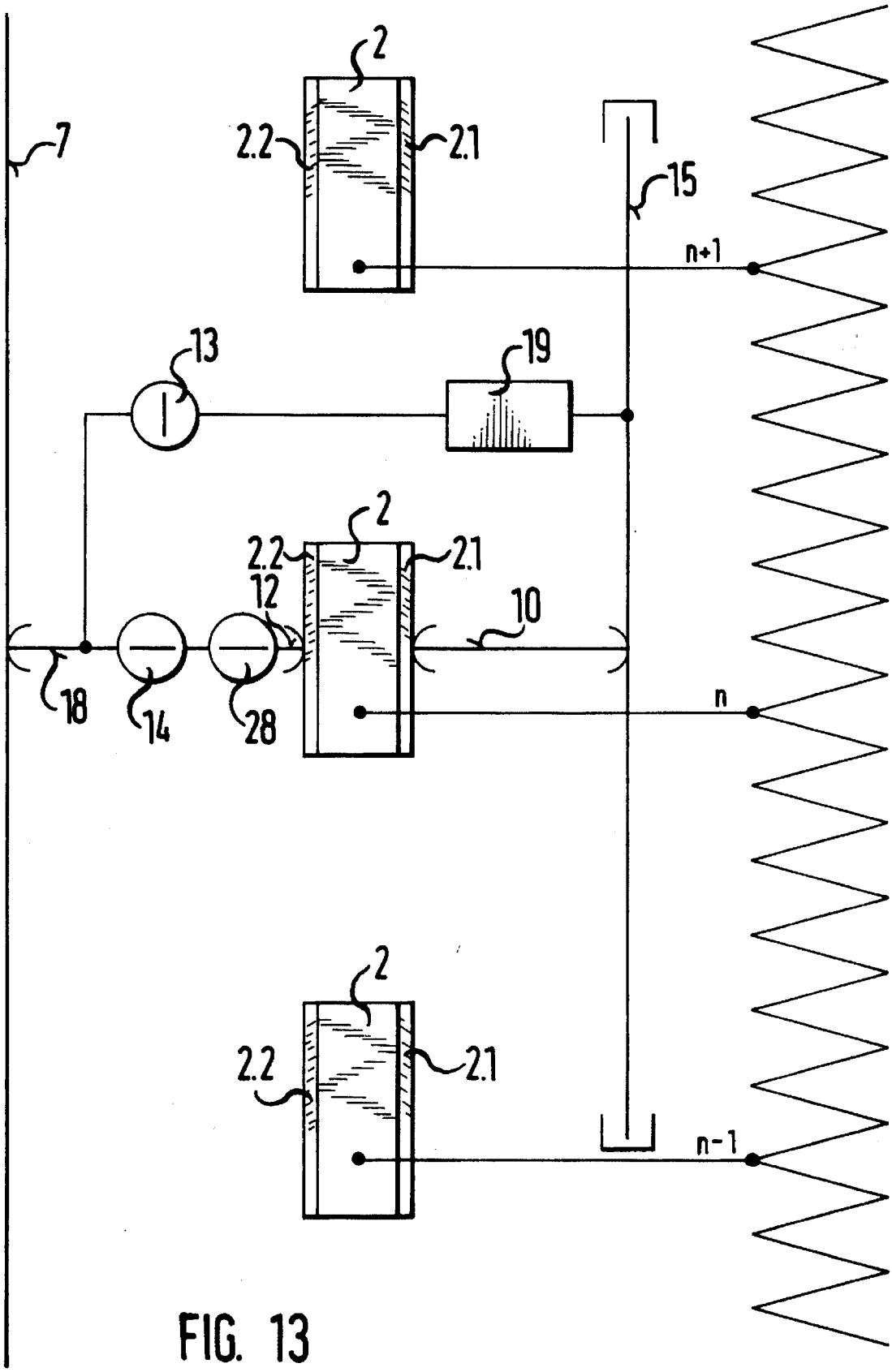
FIG. 13 also shows the switching scheme of this step switch.

In general the following current path is created in the load branch: From the contact part 2.2 of the fixed step contact 2 via the switching contact 12, a conductive connecting part 30, the third vacuum switch 28, thence via a flexible conductive bridge 31 to the second vacuum switch 14, from there finally via the conductor blade 18 to the load rail 7 of the load line. This is particularly well shown in FIG. 13.

During a load switchover the preselecting auxiliary contact 10 moves from n to (n+1) according to the desired switch path. When the auxiliary contact 10 is in the new position the driven part 11 is released; it starts its jump and the following switching steps are completed:

1. The first vacuum-tube switch 13 closes the current path,
2. the second and third vacuum-tube switches 14 and 28 switch off the current path from the load branch n to the load conductor,
3. the switch contact 12 moves from n to (n+1),
4. the second and third vacuum-tube switches 14 and 18 switch the load current path (n+1) to the conductor to complete the switchover,
5. the first vacuum-tube switch 13 switches back to the starting position.

Figure 14:
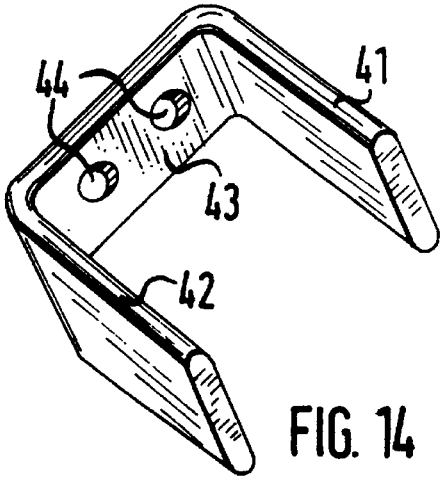
FIG. 14 shows an individual fixed contact all alone in perspective view.

FIG. 14 shows a single fixed contact 2 which is generally U-shaped and has two parallel contact legs 41 and 42 which extend parallel to each other and between which is a perpendicular connecting bight 43 which has means 44 to mechanically and electrically connect it to the respective fixed contact.

Figure 15:
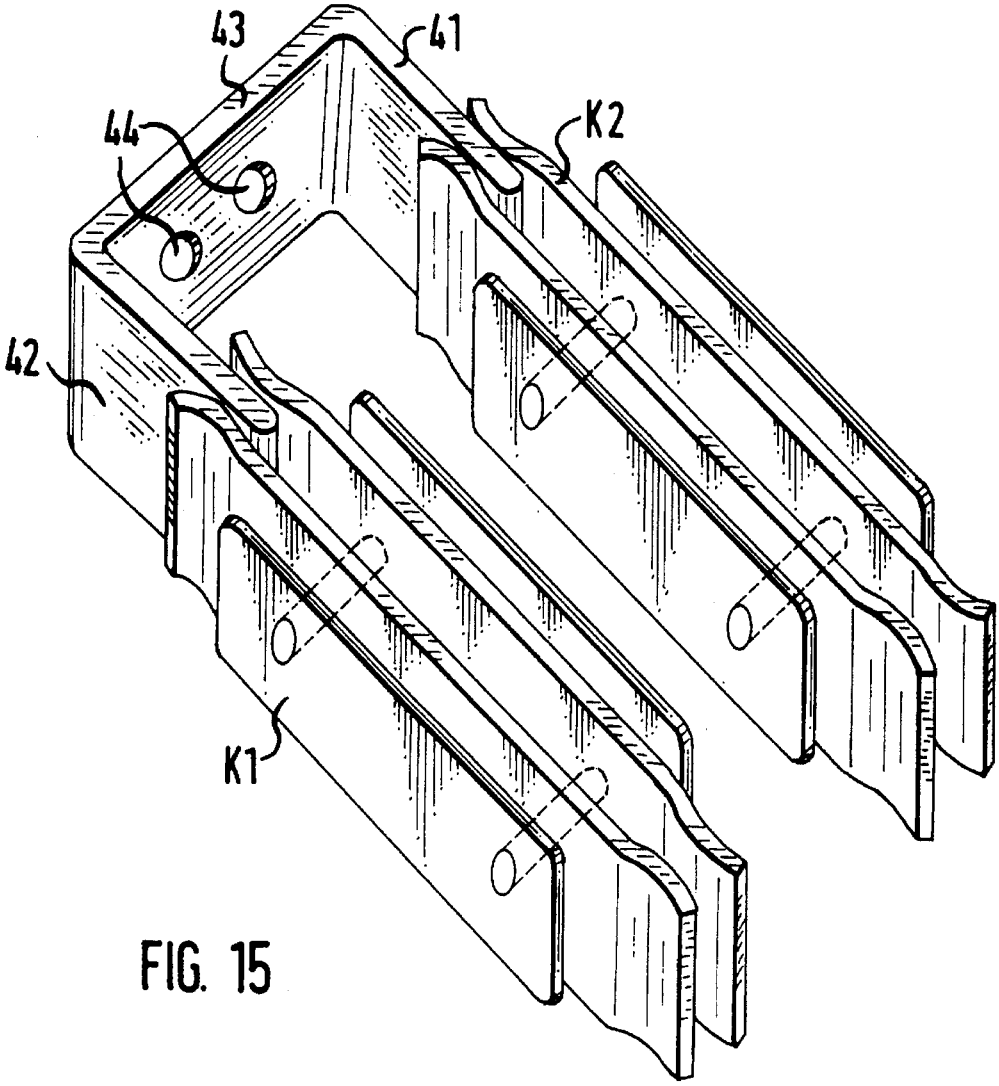
FIG. 15 shows such a fixed contact together with the two independently movable selector contacts that bridge it and that are formed as a contact bridge.

FIG. 15 shows the fixed contact shown individually in FIG. 14 with the selector contact bridges K1 and K2 which slide over it and which constitute the auxiliary contact 10 and the switch contact 12 of FIG. 9.

We claim:

1. In combination with a step transformer having a row of contacts including at least a first contact and an adjacent second contact, a step switch comprising:

a drive shaft extending along the row of transformer contacts;

a support movable relative to the drive shaft along the row of transformer contacts;

a fixed contact fixed on the support and movable therewith along the row of transformer contacts to successively engage same;

a buss conductor;

a switch connected between the fixed contact and the buss conductor;

first means for slowly displacing the support in one direction along the row for displacement of the fixed contact from the first contact to the second contact and in the opposite direction along the row for displacement of the fixed contact slowly in the opposite direction from the second contact to the first contact;

a movable contact movable relative to the support and along the row of transformer contacts;

a switch connected between the movable contact and the buss conductor;

second means including a force-storage unit connected between the movable contact and the drive shaft for, on movement of the fixed contact from the first contact to the second contact, rapidly displacing the movable contact from the first contact to the second contact once the fixed contact is moved fully to the second contact and on opposite movement of the support by the shaft for, on movement of the fixed contact from the second contact to the first contact, rapidly displacing the movable contact from the second contact to the first contact once the fixed contact is moved to the first contact.

2. The step-transformer switch defined in claim 1 wherein each of the switches is a vacuum switch.

3. The step-transformer switch defined in claim 2, further comprising another vacuum switch connected in series between the buss conductor and the switch of the movable contact; and means for generally simultaneously actuating the series-connected vacuum switches between the buss conductor and the movable contact.

4. The step-transformer switch defined in claim 1 wherein the row extends longitudinally and each transformer contact has two transversely spaced parts respectively engageable with the movable and fixed contacts.

5. The step-transformer switch defined in claim 1 wherein the drive shaft is threaded into the support carrying the fixed contact, the switch further comprising a slide carrying the movable contact and movable along the row independently of the fixed-contact support and connected via the force-storage unit with the fixed-contact support.

6. The step-transformer switch defined in claim 5 wherein the second means includes a latch for arresting the movable contact against movement along the row from the second contact to the first contact until the fixed contact has moved all the way from the second contact to the first contact and for thereupon releasing the movable contact to jump from the second contact to the first contact and vice versa on movement of the fixed contact from the first to the second contact.

7. The step-transformer switch defined in claim 4 wherein the switches are carried on the support and the conductor buss conductor is a main conductor buss conductor and is fixed relative to the transformer contacts, the step switch further comprising:

an auxiliary conductor buss conductor carried on the support, the movable contact riding on the auxiliary conductor buss conductor.

8. The step-transformer switch defined in claim 4 wherein each transformer contact is generally U-shaped.

9. The step-transformer switch defined in claim 1 wherein the force-storage unit includes a spring braced between the support and the movable contact.

10. The step-transformer switch defined in claim 9 wherein the spring surrounds the spindle.

11. The step-transformer switch defined in claim 1 wherein the movable contact is carried on and movable relative to the support.

12. The step-transformer switch defined in claim 1, further comprising:

a pair of fixed cams extending longitudinally along the rows; and switch actuating means carried on the support and engaging the cams for operating the respective switches.

13. In combination with a step transformer having a row of contacts including at least a first contact and an adjacent second contact, a step switch comprising:

a threaded drive shaft extending along the row of transformer contacts;

a support movable relative to the drive shaft along the row of transformer contacts and threaded on the drive shaft;

a fixed contact fixed on the support and movable therewith along the row of transformer contacts to successively engage same;

a buss conductor extending longitudinally along the row of transformer contacts;

a vacuum switch connected between the fixed contact and having an output riding on the buss conductor;

first means for rotating the shaft and slowly displacing the support in one direction along the row for displacement of the fixed contact from the first contact to the second contact and in the opposite direction along the row for displacement of the fixed contact slowly in the opposite direction from the second contact to the first contact;

a slide movable relative to the drive shaft and to the support;

a movable contact carried on the slide;

a switch and a resistor connected between the movable contact and the buss conductor;

second means including a spring-loaded force-storage unit braced between the slide and the support for, on movement of the fixed contact from the first contact to the second contact, rapidly displacing the movable contact from the first contact to the second contact once the fixed contact is moved fully to the second contact and on opposite movement of the support by the shaft for, on movement of the fixed contact from the second contact to the first contact, rapidly displacing the movable contact from the second contact to the first contact once the fixed contact is moved to the first contact.

* * * * *